United States Patent [19]

Kern

[11] 4,442,134

[45] Apr. 10, 1984

[54] CHEMICAL DEPOSITION TERMINATION

[75] Inventor: Werner Kern, Hightstown, N.J.

[73] Assignee: RCA Corporation, New York, N.Y.

[21] Appl. No.: 476,781

[22] Filed: Mar. 18, 1983

[51] Int. Cl.[3] ..... B05D 1/06; B05D 5/12

[52] U.S. Cl. ..... 427/9; 427/85; 427/86; 427/92; 427/331; 427/337; 427/343; 427/404; 427/419.1; 427/430.1; 427/443.2

[58] Field of Search ..... 427/331, 343, 336, 337, 427/352, 86, 85, 92, 430.1, 436, 126.1, 437, 346, 404, 419.1, 443.2, 444, 9

[56] References Cited

U.S. PATENT DOCUMENTS 3,473,960 10/1969 Jacobson et al. ..... 427/336

*Primary Examiner*—S. L. Childs

*Attorney, Agent, or Firm*—Birgit E. Morris; R. Hain Swope

[57] ABSTRACT

A method of accurately terminating the coating of a substrate in an aqueous coating solution is disclosed. The method comprises removing the substrate into an organic displacement liquid which overlies the aqueous coating solution.

19 Claims, No Drawings

CHEMICAL DEPOSITION TERMINATION

This invention relates to the coating of a substrate in aqueous medium with a material such as, for example, silver.

BACKGROUND OF THE INVENTION

The formation of a metal layer on a substrate by coating from an aqueous solution is well known. Such depositions are frequently terminated by simply removing the substrate from the coating solution and rinsing it in water. For most applications, this is adequate. However, in certain applications it is essential to precisely control the thickness of the coating, either as a final product or for further processing steps. The conventional procedure may not be satisfactory in such circumstances because of variations in the transit time from the coating solution to the rinsing solution. The problem of how to precisely control the thickness of such a coating without resorting to elaborate and/or expensive equipment has been solved in accordance with this invention.

BRIEF SUMMARY OF THE INVENTION

There is provided a method of precisely terminating application of a coating on a substrate in aqueous media by raising the substrate from the coating media into an overlying layer of an organic displacement liquid.

DETAILED DESCRIPTION OF THE INVENTION

In accordance with this invention, a method is provided whereby the immersion time of a substrate in an aqueous coating bath can be precisely terminated. The method of this invention is particularly advantageous in connection with the silver doping of a layer of germanium selenide so that it can be utilized as a photoresist in semiconductor processing.

Silver doping of a layer of germanium selenide on a substrate is carried out by immersing the substrate into an aqueous solution of a silver salt such as silver nitrate or potassium silver cyanide. The immersion time required is short, e.g. 30 seconds for a germanium selenide coated substrate in a 0.25 molar aqueous solution of potassium silver cyanide. The substrate is then rapidly removed and placed in a rinse bath to terminate the silver deposition.

The silver doping imparts photosensitivity to the germanium selenide layer which, upon exposure to ultraviolet light, becomes insoluble to a developer solution and resistant to dry etchant techniques. In order to achieve optimal sensitivity by controlling the deposited quantity of silver dopant, it is necessary to precisely terminate the immersion time of the substrate in the silver solution.

In accordance with this invention, the immersion time of a substrate in an aqueous coating solution is precisely terminated by rapidly raising the substrate from the coating solution into an overlaying layer of an organic liquid which will rapidly displace the coating solution from the substrate surface. The overlaying solution is introduced into the vessel holding the coating solution after the substrate is immersed therein. Care is taken so that mixing of the two solutions is minimal. At the completion of the required immersion time in the coating solution, the substrate is rapidly raised into the displacement liquid and held there until the last traces of the coating solution have been displaced. It is preferred to gently agitate the substrate in the displacement liquid to more rapidly remove the coating solution therefrom. It is also preferred to gently agitate the substrate while it is in the coating solution to improve the uniformity and efficiency of the coating.

The organic displacement liquid in accordance with this invention must be chemically inert to the coating solution and the substrate. In addition, the displacement liquid must have a specific gravity markedly lower than that of the aqueous coating solution and must have high solubility in water. In order to achieve maximum efficiency, the solubility of water in the displacement liquid must also be high. An organic displacement liquid would not be effective in the method of this invention were it completely hydrophobic or insoluble in water because it would not be effective in displacing the coating solution adhering to the substrate as it is withdrawn from the coating solution. It is, of course, critical that the displacement liquid rapidly penetrate to the surface of the substrate and displace the coating solution in order to accurately terminate the coating process.

Accordingly, the solubility of water in the organic displacement liquids of this invention should be at least about 0.5 percent by volume, preferably at least about 4 percent by volume, and more preferably, from about 4 to about 10 percent by volume. The solubility of the displacement fluid in water should be to at least about 0.5 and preferably at least about 10 percent by volume. More preferably, solubility of the displacement fluid in the aqueous coating solution, i.e. in water, should be from about 10 to about 30 percent by volume. These mutual solubilities are essential to the method of this invention. Suitable organic displacement liquids include, for example, low molecular weight ketones preferably methyl ethyl ketone, and mixtures of such ketones with lower alkyl esters such as ethyl acetate and/or lower alkanes such as the hexanes. The preferred displacement liquid in accordance with this invention is methyl ethyl ketone.

After displacement of the coating solution is complete, the substrate is removed from the displacement liquid and allowed to dry, preferably in an exhaust hood or similar venting device. If it is desired to rinse the substrate in water, it is first immersed in an organic liquid which is miscible with both the displacement liquid and with water such as, for example, acetone or ethanol. The substrate is then thoroughly rinsed in water and spin dried.

Because the organic displacement liquid readily forms a layer on top of the aqueous coating solution, separation of the two by mechanical means is conveniently carried out. An absolute mechanical separation is required before another substrate can be reinserted into the coating solution. A small quantity, i.e. a few drops, of the displacement liquid remaining on top of the coating solution will not affect the immersion of substrates therein. There must not be such a quantity of displacement liquid on the surface of the coating solution so as to prevent rapid, complete wetting of the substrate in the coating solution as incomplete wetting interferes with the efficiency of the coating. If it is desired to separate the two phases including the fraction of each dissolved in the other, conventional procedures such as distillation may be utilized. It can be seen, therefore, that multiple coating procedures can be carried out in accordance with this invention by a simple separation of the liquid layers as described herein.

If desired, the coating solution and the organic displacement liquid can readily be equilibrated before use. This is accomplished by vigorously shaking the two solutions together for a short time and then allowing phase separation to take place. In this way, each liquid will dissolve in the other to the extent that it will thereby assuring that the composition of the solutions will not change due to mutual solubility after the deposition process has begun. The phases must be allowed to separate before deposition can begin. It is of significant advantage that the process of this invention can be readily automated with accurate, reproducible results.

The following Example further illustrates this invention, it being understood that the invention is in no way intended to be limited to the details described therein. In the Example, all liquid parts and percentages are on a volume basis and all temperatures are in degrees Celsius, unless otherwise stated.

EXAMPLE

Potassium ferrocyanide, $K_4Fe(CN)_6.3H_2O$, was used to simulate potassium silver cyanide solution as their solubilities in water are approximately the same. An aqueous solution containing 5 percent by weight of potassium ferrocyanide and 0.4 percent by weight of the dye fluorescein sodium, as a fluorescing tracer, was used as the coating solution. The solution was maintained alkaline to keep the dye in solution.

Polished silicon wafers 5 cm in diameter were cleaned with an aqueous mixture of hydrogen peroxide and sulfuric acid to render them hydrophilic. The wafers were inserted vertically into the coating solution and timing initiated. The chosen organic displacement liquid was then introduced into the tank above the coating solution without allowing the two phases to mix. A series of displacement liquids was tested as shown in the following table. In each instance, the volume of displacement liquid was twice that of the coating solution. The substrate wafers were gently agitated automatically during the coating procedure.

At the end of a 30 second coating time, the wafers were rapidly raised into the displacement liquid. The wafers were held in the displacement liquid for one minute to assure displacement and draining of the last traces of coating solution. By dilution analysis based on ultraviolet fluoroescence measurements using a sample of the coating solution, the amount of coating solution remaining on the substrate was calculated for each displacement liquid.

| Sample No. | Displacement Fluid (DF) | Coating Solution (CS) Remaining ($10^{-4}$ ml./cm$^2$) | Solubility of CS in DF at 23° | Solubility of DF in CS at 23° |
|---|---|---|---|---|
| 1 | Methyl Ethyl Ketone (MEK) | 0.17 | 7.7 | 24.0 |
| 2 | Ethyl Acetate/MEK 90/10 | 1.0 | 4.6 | 12.0 |
| 3 | MEK/Hexane 90/10 | 1.3 | 3.7 | 9.4 |
| 4 | Equal Volumes MEK, Ethyl Acetate and Hexane | 1.3 | 0.99 | 1.4 |
| 5 | MEK/Hexane 50/50 | 2.1 | 0.60 | 0.99 |
| 6 | Hexane | 5.1 | 0.40 | 0.40 |
| 7 | None | 51.0 | N.A. | N.A. |

Sample No. 7 was measured after removing the wafers from the coating solution and allowing them to thoroughly drain. It is clear from the results in the Table that all liquids tested were effective in substantially reducing the coating solution remaining on the wafer and that methyl ethyl ketone was most effective in displacing the coating solution.

I claim:

1. A method of rapidly terminating the coating of a substrate immersed in an aqueous coating solution in a suitable vessel comprising transferring the substrate into a layer of organic displacement liquid which overlies the coating solution in said vessel, said displacement liquid and water each having a solubility in the other of at least about 0.5 percent by volume.

2. A method in accordance with claim 1, wherein the solubility of water in the displacement liquid is at least about 4 percent by volume.

3. A method in accordance with claim 2, wherein the solubility of water in the displacement liquid is from about 4 to about 10 percent by volume.

4. A method in accordance with claim 1, wherein the solubility of the displacement fluid in water is at least about 10 percent by volume.

5. A method in accordance with claim 4, wherein the solubility of the displacement fluid in water is from about 10 to about 30 percent by volume.

6. A method in accordance with claim 1, wherein the organic displacement liquid is a low molecular weight ketone or a mixture thereof with one or more members of the group consisting of lower alkyl esters and lower alkanes.

7. A method in accordance with claim 6, wherein the organic displacement is methyl ethyl ketone or a mixture thereof with one or more members of the group consisting of ethyl acetate and hexane.

8. A method in accordance with claim 7, wherein the organic displacement liquid is methyl ethyl ketone.

9. A method of forming a coating of a material on a substrate comprising:

(a) providing an aqueous solution of said material in a suitable vessel;

(b) immersing the substrate in said solution;

(c) introducing into the vessel an organic displacement liquid so that it forms a layer overlying the aqueous coating solution, said liquid and water each having a solubility in the other of at least about 0.5 percent by volume; and (d) when a predetermined amount of material has been deposited on the substrate, rapidly raising the substrate into the displacement liquid thereby terminating the coating of the substrate.

10. A method in accordance with claim 9, wherein the solubility of water in the displacement liquid is at least about 4 percent by volume.

11. A method in accordance with claim 10, wherein the solubility of water in the displacement liquid is from about 4 to about 10 percent by volume.

12. A method in accordance with claim 9, wherein the solubility of the displacement fluid in water is at least about 10 percent by volume.

13. A method in accordance with claim 10, wherein the solubility of the displacement fluid in water is from about 10 to about 30 percent by volume.

14. A method in accordance with claim 9, wherein the organic displacement liquid is a low molecular weight ketone or a mixture thereof with one or more members of the group consisting of lower alkyl esters and lower alkanes.

15. A method in accordance with claim 14, wherein the organic displacement is methyl ethyl ketone or a mixture thereof with one or more members of the group consisting of ethyl acetate and hexane.

16. A method in accordance with claim 15, wherein the organic displacement liquid is methyl ethyl ketone.

17. A method in accordance with claim 9, wherein the aqueous solution contains one or more silver salts and the coating being formed on the substrate is silver.

18. A method in accordance with claim 17, wherein the aqueous solution contains potassium silver cyanide.

19. A method in accordance with claim 17 wherein the substrate has on at least one surface a layer of germanium selenide, which layer receives the coating.

* * * * *